US006398523B1

(12) United States Patent
Hur et al.

(10) Patent No.: US 6,398,523 B1
(45) Date of Patent: Jun. 4, 2002

(54) LINEAR COMPRESSOR

(75) Inventors: Kyung Bum Hur, Seoul; Hyuk Lee, Koyang, both of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/576,314

(22) Filed: May 22, 2000

(30) Foreign Application Priority Data

Aug. 19, 1999 (KR) ..... 1999-34393
Aug. 19, 1999 (KR) ..... 1999-34394
Sep. 4, 1999 (KR) ..... 1999-37570

(51) Int. Cl.[7] ..... F04B 17/04; F04B 35/04; F04B 39/10; F04B 53/12; F04B 53/00

(52) U.S. Cl. ..... 417/417; 417/416; 417/547; 417/312

(58) Field of Search ..... 417/417, 416, 417/547, 312

(56) References Cited

U.S. PATENT DOCUMENTS 4,121,125 A * 10/1978 Dolz ..... 310/27
4,632,645 A * 12/1986 Kawakami et al. ..... 417/417
5,704,771 A * 1/1998 Fujisawa et al. ..... 417/417
5,722,817 A * 3/1998 Park et al. ..... 414/312

* cited by examiner

*Primary Examiner*—Charles G. Freay
*Assistant Examiner*—Timothy P. Solak
(74) *Attorney, Agent, or Firm*—Birch, Stewart, Kolasch & Birch, LLP

(57) ABSTRACT

The present invention relates to a linear compressor, and in particular, to a linear compressor which is capable of decreasing the specific volume of a sucked refrigerant gas by decreasing the amount of the refrigerant gas to be introduced into a suction opening of a hermetic vessel thereby to be sucked into a cylinder, which is to be mixed with a high temperature refrigerant gas with which the hermetic vessel is filled, and decreasing the suction loss of a refrigerant gas to thus improve the performance efficiency of the compressor and reduce noise generated during the suction of the refrigerant gas by preventing some of the refrigerant gas to be leaked out to the inner space of the cover. The linear compressor of the invention includes a hermetic vessel having a suction opening at one side, a motor and a cylinder disposed inside the hermetic vessel, a piston inserted into the cylinder having a refrigerant flow path formed inside, a cover installed inside the hermetic vessel in the state of enclosing the cylinder and the piston and having a through opening at one side, a resonance spring elastically supporting the motion of the piston, and a refrigerant suction guide and noise canceling unit installed to communicated with the suction opening of the hermetic vessel for directly sucking the refrigerant gas introduced into the hermetic vessel into the refrigerant flow path of the piston.

19 Claims, 13 Drawing Sheets

LINEAR COMPRESSOR

BACKGROUND OF THE INVENTION

1. Field of the Invention

The present invention relates to a linear compressor, and in particular, to a suction guide noise reduction structure for a linear compressor which is capable of decreasing the specific volume of a sucked refrigerant gas, increasing the flow rate, and decreasing suction noise of the refrigerant gas by decreasing the amount of the refrigerant gas introduced from a suction opening of a hermetic vessel to be mixed with a high temperature refrigerant gas with which the hermetic vessel is filled.

2. Description of the Background Art

Generally, a compressor in a refrigerating cycle apparatus compresses refrigerant introduced from an evaporator, and then discharges it to a condenser in a high temperature and high pressure state.

In a conventional linear compressor, a piston is connected to a magnet assembly constituting an operator of a linear motor in place of a crankshaft thus to be integrally fixed to the magnet assembly. As the linear driving force of the motor is transferred to the piston, the piston linearly reciprocates in the cylinder to thus suck and compress refrigerant gas.

As shown in FIG. 1, a conventional compressor includes: a hermetic vessel 1 having a discharge opening (not shown) formed at one side and a suction opening la connected with a suction tube 2 at the other side; a frame 10 formed in a predetermined shape mounted inside the hermetic vessel 1; a cylinder 20 inserted into a through hole 3 formed through the central portion of the frame 10; an inner stator assembly 30 connected to an inner side of the frame 10 for constructing a linear motor and an outer stator assembly 31 connected to the inner side of the frame 10 at a predetermined interval; a magnet 32 disposed at a gap formed between the inner stator assembly 30 and the outer stator assembly 31; and a piston 40 inserted into the cylinder 20 and connected to a magnet assembly 33 connected with the magnet 32 for thereby reciprocating by the linear motion of the magnet 32.

A refrigerant flow path (F) through which refrigerant gas flows is formed inside the piston 40.

In addition, at one side of the cylinder 20, a cap shaped discharge cover 60 is connected to one side of the frame 10, wherein a discharge valve assembly 61 for opening and closing one side of the cylinder 20 is inserted into the discharge cover 60.

In addition, a suction valve 62 opened and closed according to the suction of refrigerant gas is connected to an end portion of the piston 40, and an oil feeder 70 for feeding oil in order to supply a sliding friction portion between elements with oil, is mounted at a lower portion of the frame 10.

In addition, a cover 50 is connected to the other side of the frame 10. And an inner resonance spring 51*a* inserted between a portion of the frame 10 disposed at the outer side of the cylinder 20 and an inner surface of the magnet assembly 33, and an outer resonance spring 51*b* inserted between an outer surface of the magnetic assembly 33 and an inner surface of the cover 50, are disposed at both sides of the magnet assembly 33 connected with the piston, so that they elastically support the piston 40.

Reference numeral 34 denotes a stator coil assembly of the linear motor.

The operation of the conventional linear compressor having the above-described structure is as follows.

When current is applied to the linear motor, the magnet 32 linearly reciprocates, and said linear motion is transferred to the piston 40 connected to the magnet assembly 33 so that the piston 40 linearly reciprocates in the cylinder 20.

A pressure difference is generated in the cylinder 20 by the linear motion of the piston 40. As refrigerant gas introduced into the hermetic vessel 1 via the suction opening 1*a* by this pressure difference in the cylinder 20, is introduced into the refrigerant flow path (F) formed inside the piston 40, sucking the refrigerant gas into the cylinder 20 via the suction valve 62, compressing the sucked refrigerant gas, and discharging the compressed refrigerant gas through the discharge valve assembly 61 and the discharge cover 60 are repeatedly performed.

In addition, the refrigerant gas of high temperature and high pressure is discharged through a tube connecting the discharge cover 60 and the discharge opening of the hermetic vessel 1 and then is introduced into a condenser (not shown). Thereafter, it is introduced into the condenser (not shown) constructing the refrigerating cycle apparatus, and then the refrigerant gas of low temperature and low pressure, which has passed again through the evaporator during a refrigerating cycle is introduced into the compressor.

Meanwhile, the compression efficiency in compressing the refrigerant gas, as the piston 40 reciprocates in the cylinder 20 is inversely proportional to the specific volume of the refrigerant gas. In order to decrease the specific volume of the refrigerant gas during the suction stroke, there has been a continuous effort to lower the temperature of the refrigerant gas when the refrigerant gas introduced into the suction opening 1*a* is introduced into the cylinder 20, because the temperature in the hermetic vessel 1 is high.

As an example of a conventional structure for preventing the heating of the refrigerant gas when the refrigerant gas is introduced into the cylinder 20 via the suction opening la of the hermetic vessel 1, as shown in FIG. 2, a suction induction tube 80 of which one side is extensively opened and which has a predetermined length in order for the refrigerant gas to be introduced into the suction opening 1*a*, is fixedly inserted into the refrigerant gas flow path (F) at a predetermined interval from the suction opening 1*a*.

The suction induction tube 80 which moves together with the piston 40 is designed to be spaced apart from the suction opening 1*a* so that friction may not occur between an end portion of the suction induction tube 80 and an inner surface of the hermetic vessel 1 as the piston 40 reciprocates.

In the above-mentioned conventional linear compressor, however, there has been a problem in that since there must be a large interval between the suction induction tube 80 and the suction opening 1*a*, the sucked refrigerant gas is mixed with high temperature refrigerant gas in the hermetic vessel 1, thus increasing the specific volume of the refrigerant gas sucked into the cylinder.

In order to solve the above problem, as shown in FIG. 3, there is provided a structure in which the sucked refrigerant gas is introduced not into the hermetic vessel 1, but only into the cylinder 20 via a suction guide 81 and a suction induction tube 80' by connecting an end portion of the suction induction tube 80' inserted into the piston 40 and the suction opening 1*a* of the hermetic vessel 1 by means of the additional suction guide 81.

In the structure described above, the refrigerant gas is not mixed with the high temperature refrigerant gas with which the hermetic vessel is filled. However, there is a problem in that it is not easy to install the suction guide between the suction induction tube moving along with the piston and the hermetic vessel in a fixed state, and even after the installation, the suction guide may be easily damaged.

Meanwhile, as another example of the conventional linear compressor, as shown in FIG. 4, there is provided a structure in which a suction guide member 90 for guiding the suction of the refrigerant gas and decreasing noise during the suction of the refrigerant gas is mounted at the magnet assembly 33 and, inserted into the opening portion of the refrigerant flow path (F).

In detail, as shown in FIG. 5, in the suction guide member 90, a first small diameter portion 11 constituting a throat part is formed to be inserted into the refrigerant flow path (F) of the piston 40, a large diameter portion 12 of which one end communicates with the first small diameter portion 11 to form a resonance chamber is tightly formed at the rear end surface, that is, the opening portion of the piston 40, and a second small diameter portion 13 communicating with the other end of the large diameter portion 12 to thus form a suction opening is formed to be exposed to a refrigerant vent hole 2*a* of the cover 50.

In the conventional linear compressor thusly constructed, noise generated during the process of sucking the refrigerant gas via the suction valve 62 of the piston 40, is reduced by the acoustic characteristics while passing through the first small diameter portion 11 and large diameter portion 12 of the suction guide member 90.

Like reference numerals designate like composing elements illustrated in FIGS. 1 through 3. Thus, the description of such composing elements is omitted herein.

However, in order to increase the noise reduction amount of the suction guide member 90, the small diameter portion 11 has to be decreased or the effective volume (V1) of the resonance chamber has to be increased. In the conventional linear compressor described above in the case that the sectional area of the first small diameter portion 11 is too small, an intake loss of the refrigerant gas occurs to thereby degrade the compressor efficiency, and accordingly the decrease of the sectional area is limited. Since the suction guide member 90 is disposed at an inner space of the outer resonance spring 51*b* inside the cover 50 thus to reciprocate along with the piston 40, the increase of the effective volume (V1) of the resonance chamber is limited, thereby degrading both compression efficiency and noise reduction effect.

In addition, in the conventional linear compressor described above, the low temperature refrigerant introduced into the hermetic vessel 1 and into the cover 50 is mixed with high temperature refrigerant existing between the outside of the cover 50 and the hermetic vessel 1. Thus, there is a problem that the efficiency of the compressor is degraded.

More specifically, the suction guide member 90 integrally formed with the piston 40 has a large motion displacement, so that it has to maintain a considerable distance from the hermetic vessel 1. Thus, there is a problem that the high temperature refrigerant between the hermetic vessel 1 and the cover 50 is likely to be introduced into the suction guide member 90, and the efficiency of the compressor is degraded because the specific volume of the high temperature refrigerant is high.

SUMMARY OF THE INVENTION

Accordingly, it is an object of the present invention to provide a linear compressor which is capable of decreasing the specific volume of a sucked refrigerant gas by decreasing the amount of the refrigerant gas introduced from a suction opening of a hermetic vessel which is mixed with high temperature refrigerant gas with which the hermetic vessel is filled.

It is another object of the present invention to provide a linear compressor in which it is easy to install elements for guiding the suction of refrigerant gas.

It is still another object of the present invention to provide a linear compressor having at least one resonance chamber in order to substantially improve the noise reduction effect while maintaining the throat part of a suction guide member or the resonance chamber to be suitable for the efficiency of the compressor.

In order to achieve the above objects, there is provided a suction guide and noise reduction structure for a linear compressor including a hermetic vessel having a suction opening at one side thereof, a cylinder disposed inside the hermetic vessel, a piston inserted into the cylinder and having a refrigerant flow path formed inside, and a cover installed inside the hermetic vessel in the state of enclosing the cylinder and the piston and having a through opening at one side, which includes a suction guide tube connected with the through opening of the cover and fixed to the cover, said suction guide tube guiding refrigerant gas from the suction opening, and a suction induction tube fixedly connected with the refrigerant flow path at one end thereof and movably connected at the other end thereof with one end portion of the suction guide tube.

BRIEF DESCRIPTION OF THE DRAWINGS

The present invention will become better understood with reference to the accompanying drawings which are given only by way of illustration and thus are not limitative of the present invention, wherein.

DETAILED DESCRIPTION OF THE PREFERRED EMBODIMENTS

Figure 1:
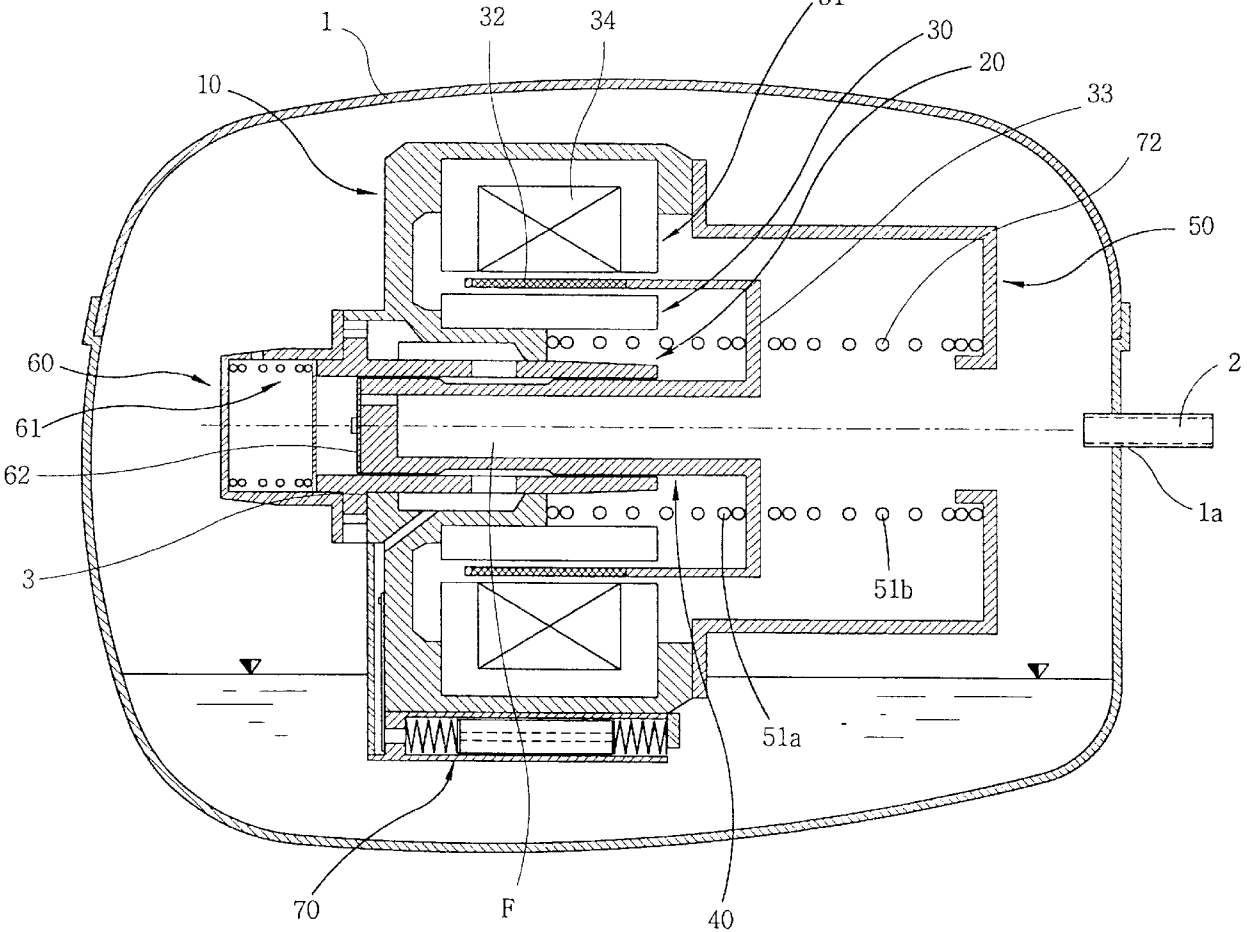
FIG. 1 CONVENTIONAL ART
FIG. 1 is a cross-sectional view illustrating a conventional linear compressor.
Figure 2:
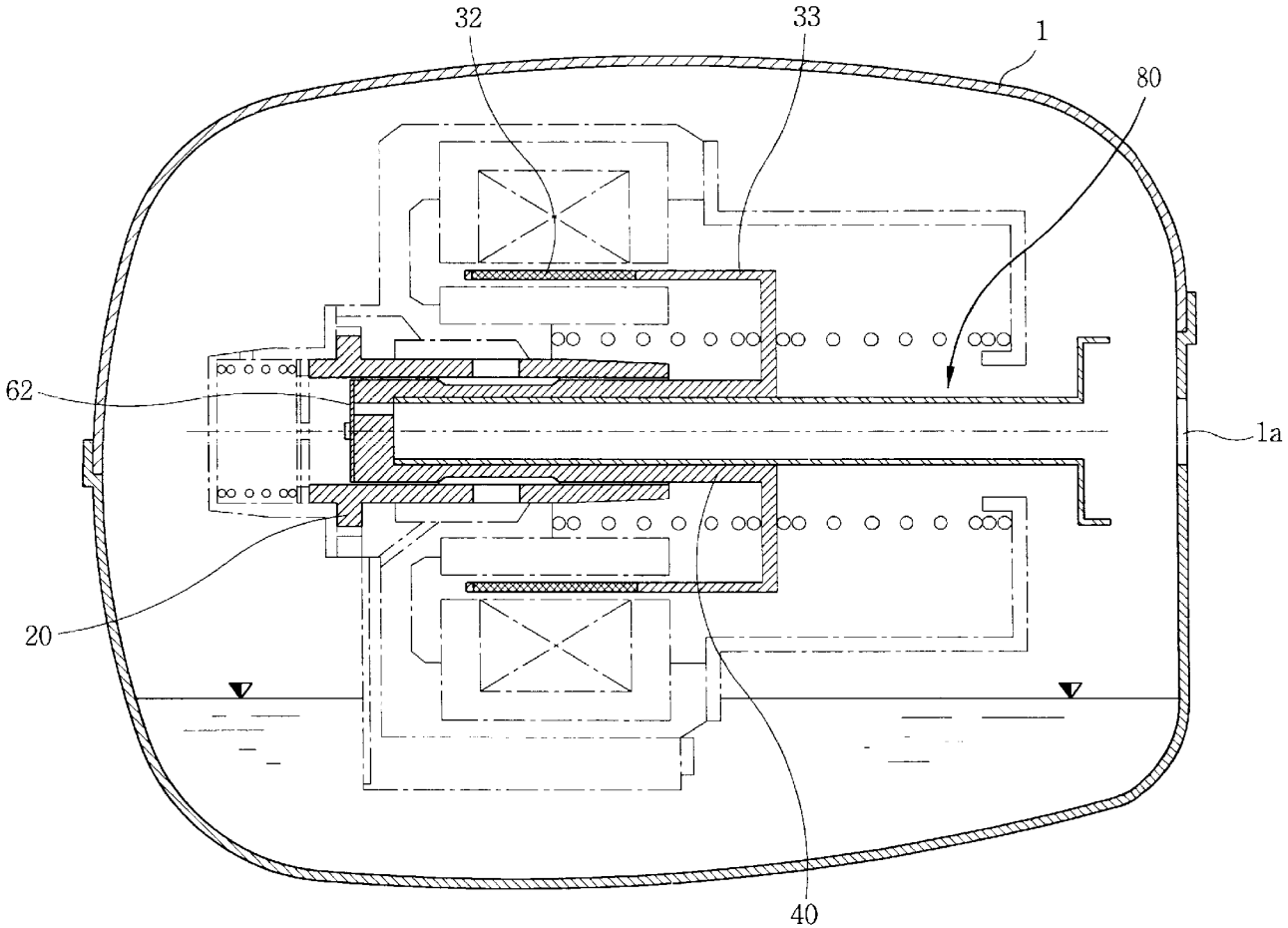
FIG. 2 CONVENTIONAL ART
FIG. 2 is a cross-sectional view illustrating the shape of a suction induction tube installed in a conventional linear compressor.
Figure 3:
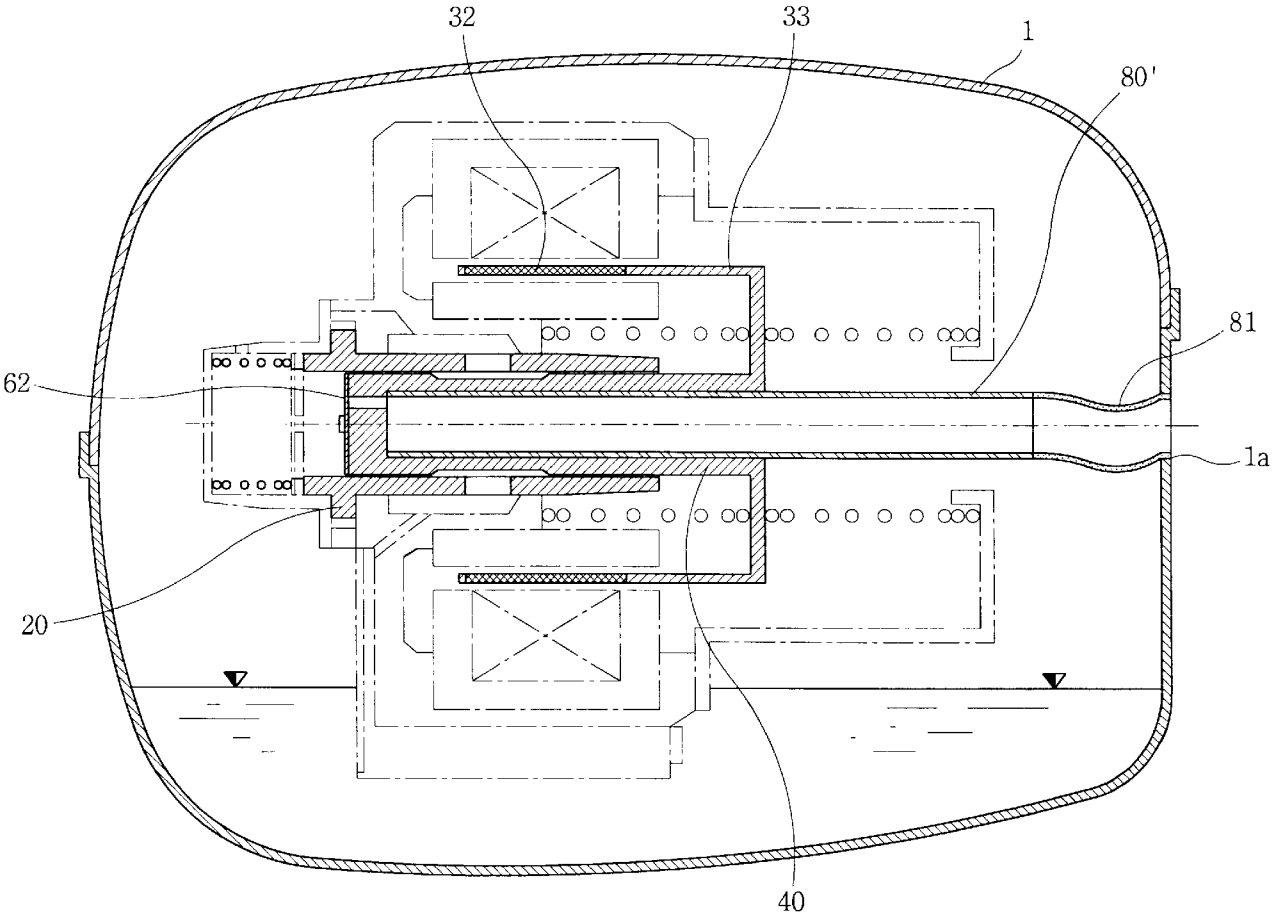
FIG. 3 CONVENTIONAL ART
FIG. 3 is a cross-sectional view illustrating the shape of another suction induction tube installed in a conventional linear compressor.
Figure 4:
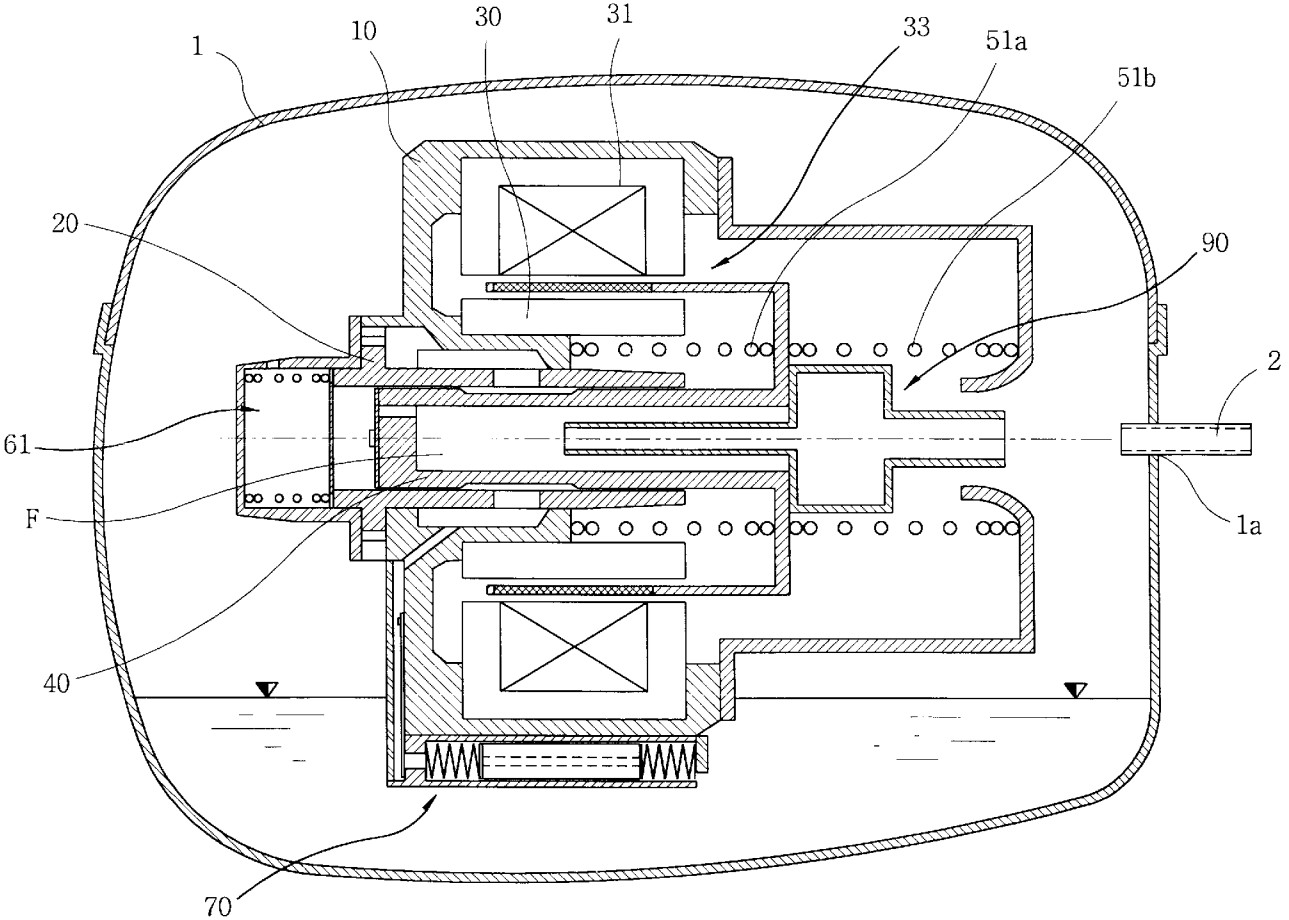
FIG. 4 CONVENTIONAL ART
FIG. 4 is a cross-sectional view illustrating the shape of still another suction induction tube installed in a conventional linear compressor.
Figure 5:
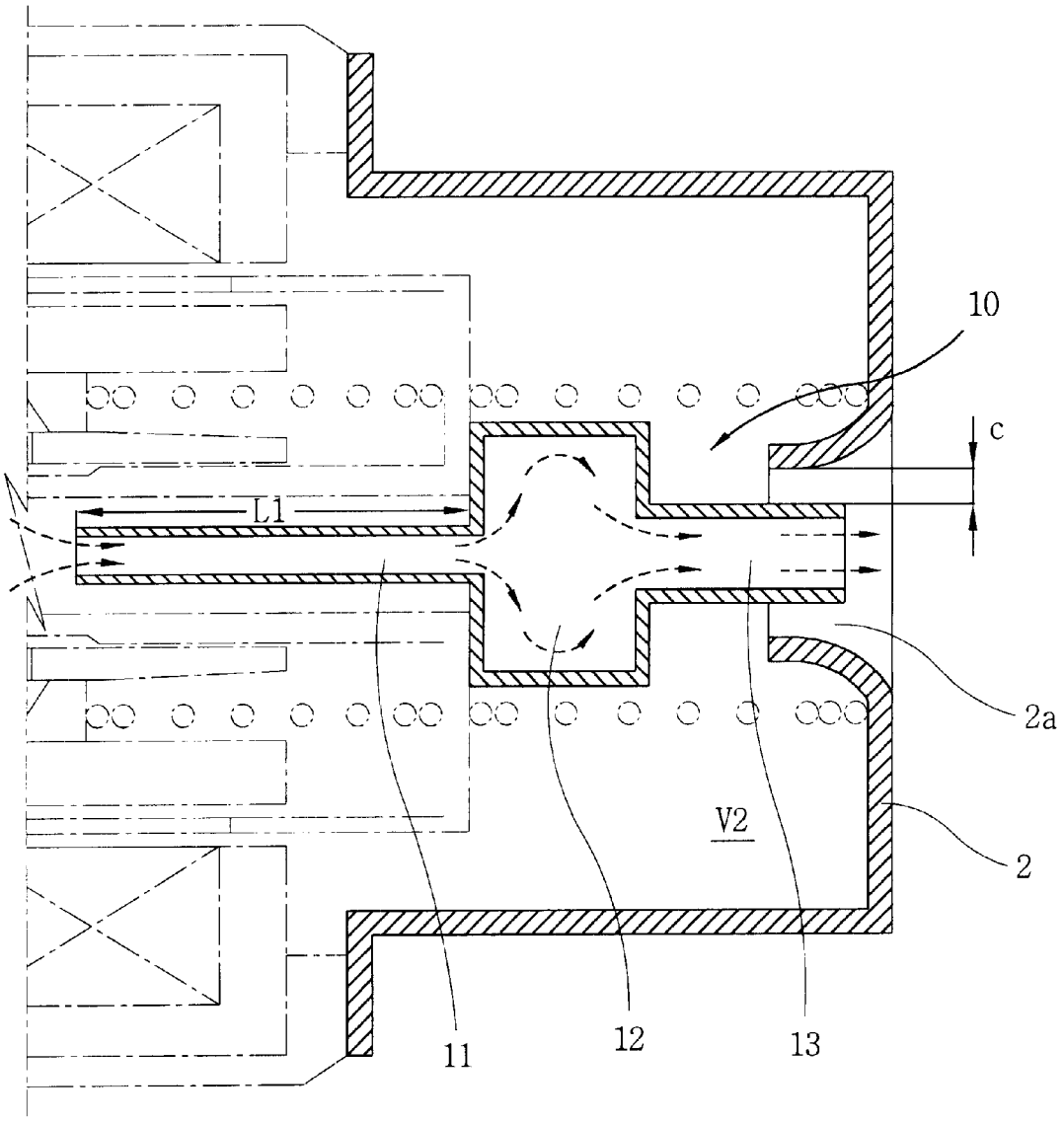
FIG. 5 CONVENTIONAL ART
FIG. 5 is a partial vertical cross-sectional view illustrating the shape of the installed suction induction tube of FIG. 4.

The preferred embodiments of the present invention will now be described with reference to the accompanying drawings.

In the drawings, like reference numerals designate like composing elements of the above-described conventional linear compressor. Thus, the description of such composing elements may be omitted herein.

Figure 6:
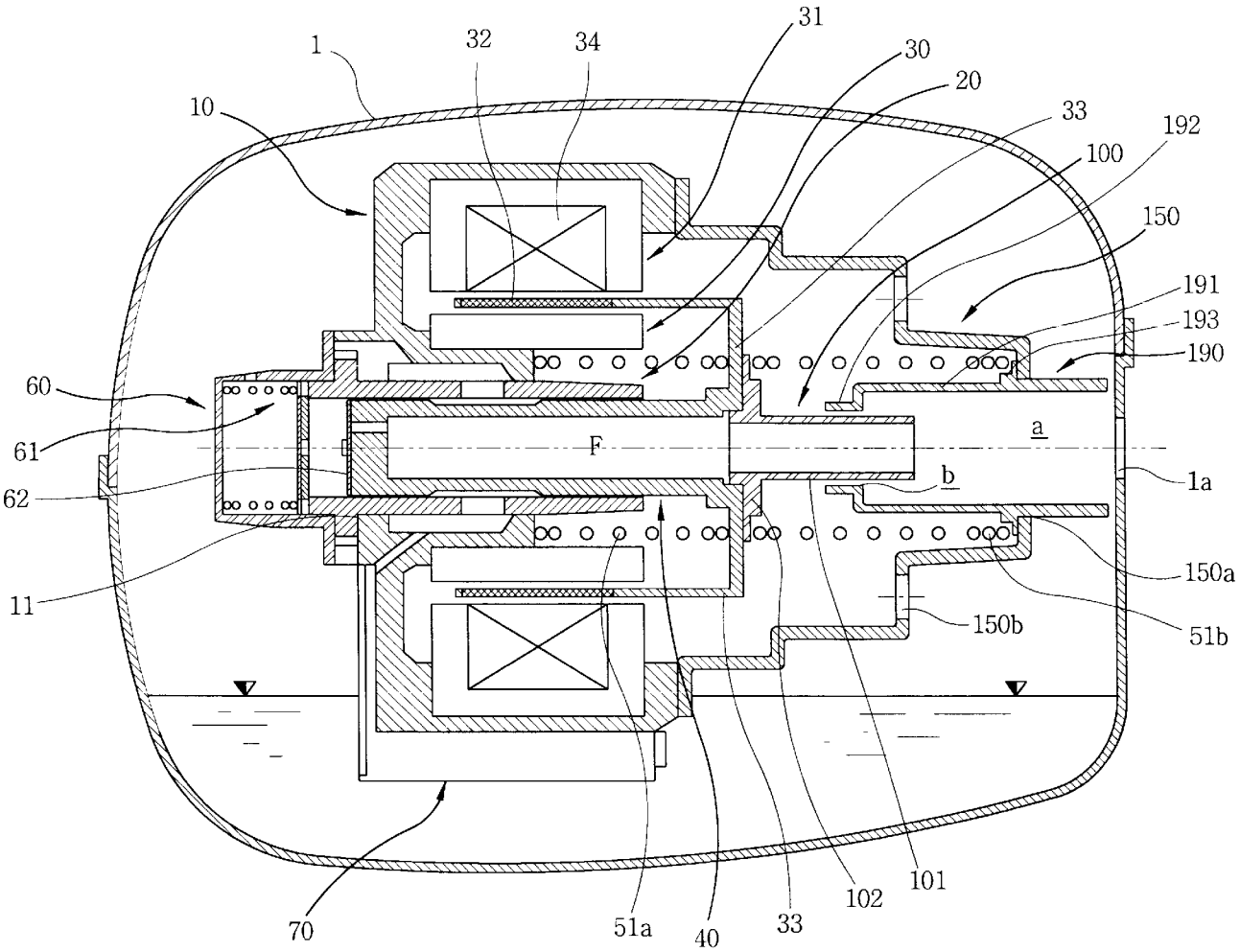
FIG. 6 is a cross-sectional view of a linear compressor in accordance with a first embodiment of the present invention.

As illustrated in FIG. 6, the linear compressor in accordance with a first embodiment of the present invention includes: a hermetic vessel 1 having a suction opening 1*a* at one side; a frame 10 mounted inside the hermetic vessel 1; a motor mounted at one side of the frame 10; a cylinder 20 connected to the inside of the frame 10; a piston 40 inserted into the cylinder 20 and having a refrigerant flow path (F) in which refrigerant gas flows, formed inside the piston 40; an operator of the motor for transferring the driving force of the motor to the piston 40; a cover 150 formed in a cap shape of which one side is opened and in which a through opening 150*a* is formed at the other side, and fixedly connected to one side of the motor so as to enclose the cylinder 20 and the piston 40; and an inner resonance spring 51*a* and an outer resonance spring 51*b* disposed respectively at both sides of the piston 40 for elastically supporting the motion of the piston 40, which construction is similar to that of a conventional linear compressor.

The linear compressor further includes: a suction guide member 190 formed with a predetermined length for communicating with the suction opening 1*a* of the hermetic vessel 1 and inserted into the through opening 150*a* of the cover 150 to be fixed at an outer end portion of the cover 150; and a suction induction tube 100 having a muffler function, of which one side is movably inserted into the suction guide member 190 and of which the other side is fixedly connected at an end portion of the piston 40 for thereby guiding the refrigerant gas introduced to the refrigerant flow path (F) of the piston 40 via the suction guide member 190 while moving along with the piston 40.

The structure of the suction guide member 190 will be described in detail, as follows.

The suction guide member 190 includes: a first tube unit 191 which has a certain thickness, an outer diameter disposed to communicate with the through opening 150*a* of the cover 150 and a first inner diameter (a) with a certain diameter; a second tube unit 192 contracted and extended from the first tube unit 191 to thus be formed in a second inner diameter (b) larger than the outer diameter of the suction induction tube 100; and a bridging unit 193 extended and extruded at a circumferential surface of the first tube unit 191 at a predetermined thickness and length to thus be in contact with and be supported by the inner surface of the cover 150.

In the suction guide member 190, the end of the first tube unit 191 is installed at a side portion of the suction opening 1*a* so that it remains at a minimum interval from the inner surface of the hermetic vessel 1 in the state of not being in contact with the inner surface of the hermetic vessel 1.

In the suction guide member 190, it is preferable that the bridging unit 193 is fastened and fixed by a screw in the state of being in contact with the inner surface of the cover 150.

In addition, the suction induction tube 100 includes a tube unit 101 which has a certain length, an outer diameter smaller than the inner diameter of the second tube unit 192 and a certain inner diameter, and a bridging unit 102 extended and extruded at the circumferential surface of one side of the tube unit 101 at a predetermined thickness and height.

In the suction induction tube 100, one side of the tube unit 101 is inserted into the second tube unit 192 of the suction guide member 190; and the other side of the tube unit 101 is inserted into the refrigerant flow path (F) of the piston 40, and the bridging unit 102 is in contact with and is supported by a section of the piston 40.

In the suction induction tube 100, it is preferable that the bridging unit 102 is fastened and fixed to the piston 40 by a screw in the state of being in contact with the section of the piston 40.

Meanwhile, a plurality of through holes 150*b* are formed at one side of the cover 150 so that the refrigerant gas disposed at the inner side of the cover 150 and the refrigerant gas disposed at the outer side of the cover 150 are communicated with each other.

Hereinafter, the operational effect of the linear compressor in accordance with the first embodiment of the present invention will now be described.

In the linear compressor of the invention, when a current is applied to the motor, a magnet 32 constructing the operator of the motor linearly reciprocates. Said linear motion is transferred to the piston 40 via the magnet assembly 33, and thus the piston 40 linearly reciprocates in the cylinder 20. As the suction, compressing and discharging stokes are repeatedly performed by the linear reciprocating motion of the piston 40, thus discharging the refrigerant gas at a high temperature and high pressure.

At this time, the suction induction tube 100 connected to the end portion of the piston 40 linearly reciprocates in the suction guide member 190 by the linear reciprocating motion of the piston 40.

During the above suction stroke, when the piston 40 moves from top dead center to bottom dead center, the inside of the cylinder 20 turns to a low pressure state. As the result, the refrigerant having passed through an evaporator is sucked into the suction guide member 190 via the suction opening 1*a*, and at the same time it is sucked into the cylinder 20 via a suction valve 62 while passing through the suction induction tube 100 and the refrigerant flow path (F) of the piston 40.

At this time, the suction guide member 190 is fixedly connected to the cover 150 fixed at the motor, and the suction induction tube 100 is connected to the piston 40, both of which perform a relative movement. Thus, the motion of the suction guide member 190 fixed at the cover 150 is greatly reduced, so that the suction guide member 190 and the suction opening 1*a* can be connected by making the suction guide member 190 closer to the inner surface of the hermetic vessel 1, whereby the amount of the refrigerant gas sucked during the suction of the refrigerant gas, which is mixed with the high temperature refrigerant gas in the hermetic vessel 1 is reduced.

In addition, since the hermetic vessel 1 is separated from the suction guide member 190, there is no possibility that the suction guide member 190 may be damaged during the operation of the compressor, and it is made easy to install the suction guide member 190 and the suction induction tube 100.

Figure 7:
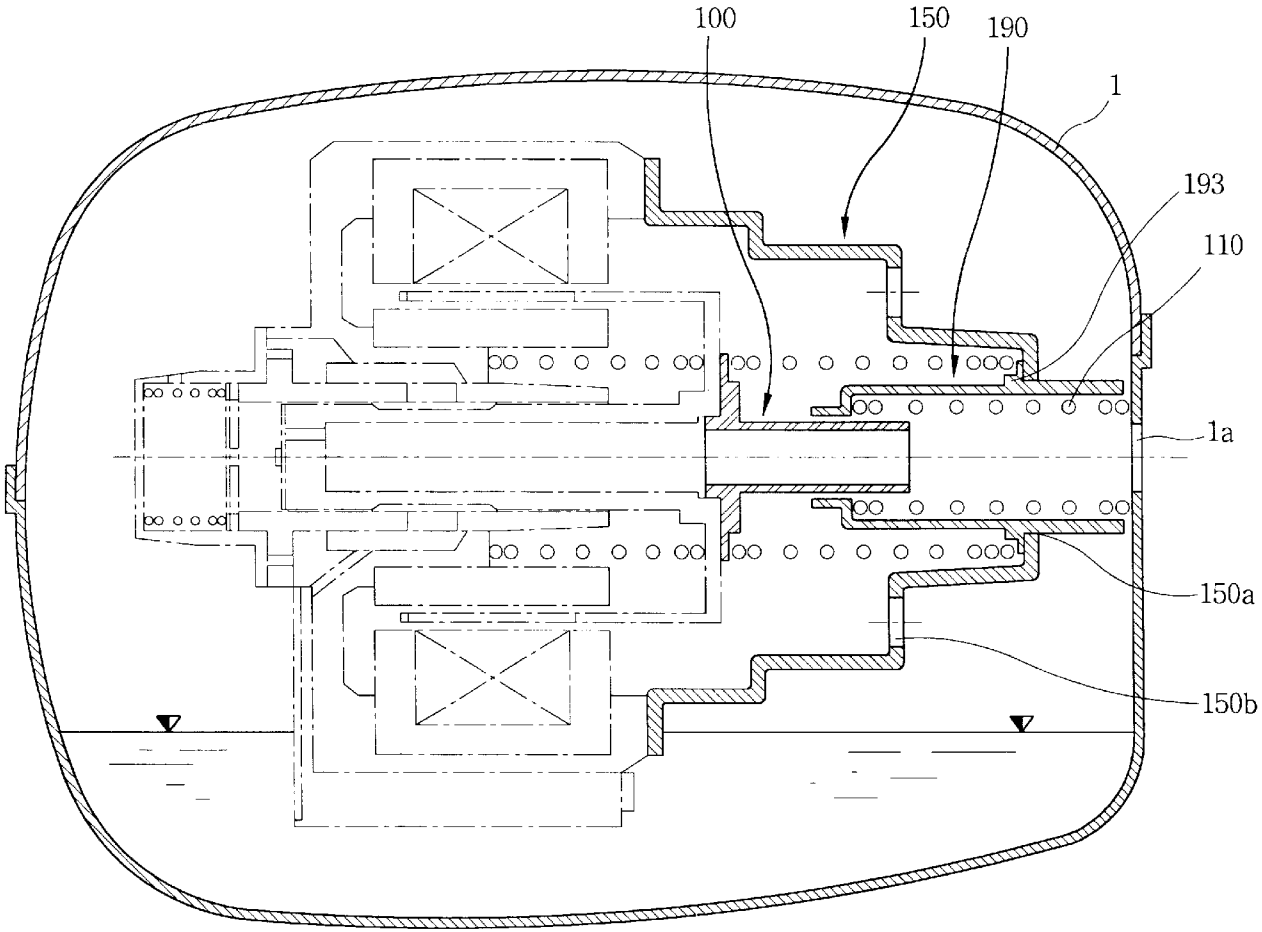
FIG. 7 is a cross-sectional view illustrating a linear compressor in accordance with a modified first embodiment of the present invention.

In a modification of the first embodiment of the present invention, as shown in FIG. 7, a space maintaining spring 110 is inserted into the suction guide member 190 in order to prevent a collision between the suction guide member 190 and the hermetic vessel 1.

The space maintaining spring 110 is disposed at an inner wall of the second tube unit 192 and an inner wall of the hermetic vessel 1, being in contact with them.

The space maintaining spring 110 prevents the collision between the suction guide member 190 and the hermetic vessel 1 when vibration occurs to the frame 10 to which the cover 150 is fixedly connected.

Hereinafter, the linear compressor in accordance with a second embodiment of the present invention will be described in detail with reference to the accompanying drawings.

With respect to the same structure as of the first embodiment described above, there will be no additional description thereof, and the same reference numerals will be used in the drawings.

Figure 8:
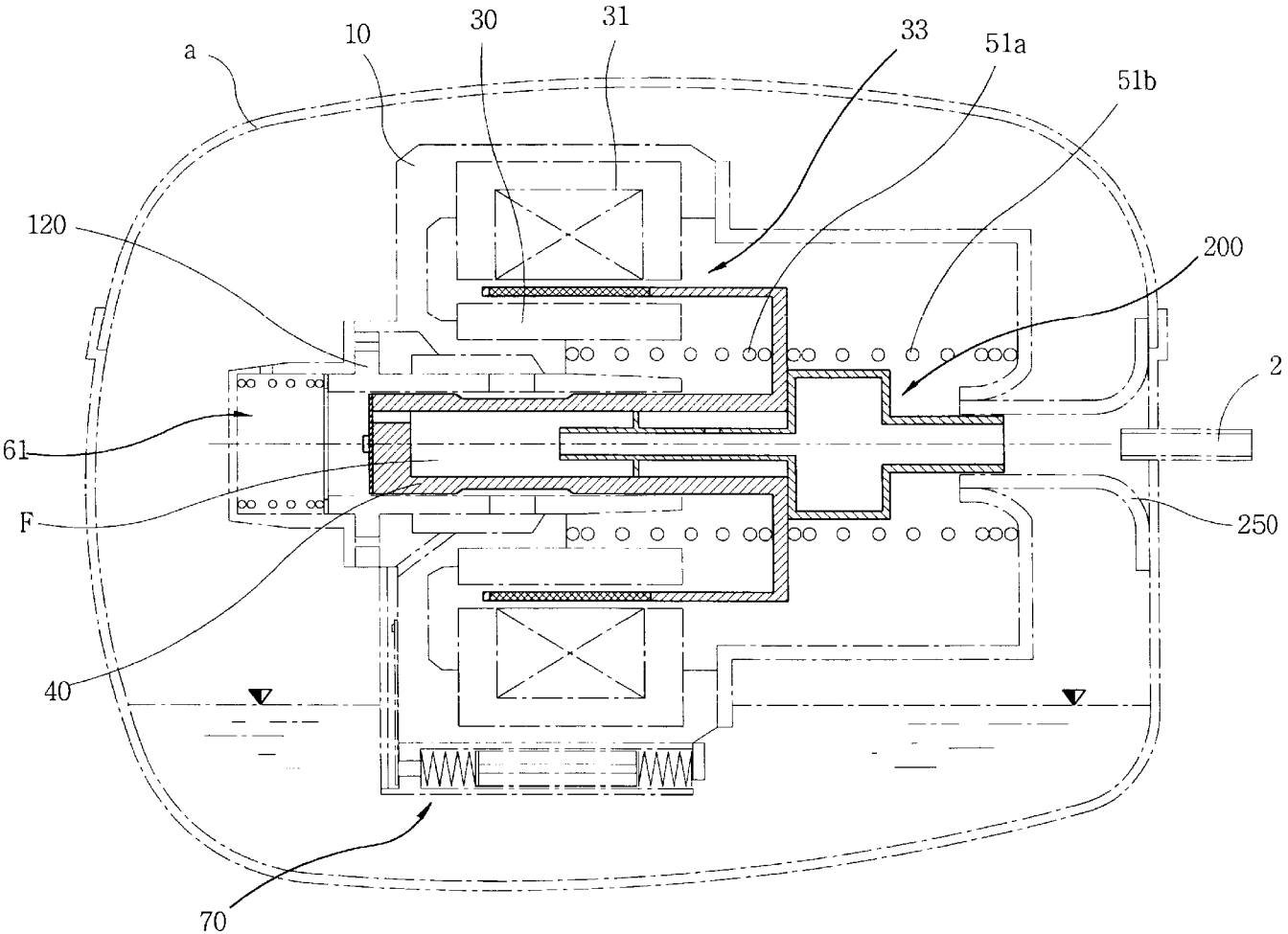
FIG. 8 is a vertical cross-sectional view illustrating a linear compressor in accordance with a second embodiment of the present invention.

As shown in FIG. 8, the linear compressor in accordance with the second embodiment of the present invention includes a suction induction member 200 mounted at the refrigerant flow path (F) of the piston 40 for guiding the suction of the refrigerant gas and decreasing noise during the suction of the refrigerant gas.

In addition, the linear compressor is characterized in that the suction induction member 200 has a muffler function, and the inner diameter of the piston 40 has a resonator function and it is utilized as a space for the muffler.

Figure 9:
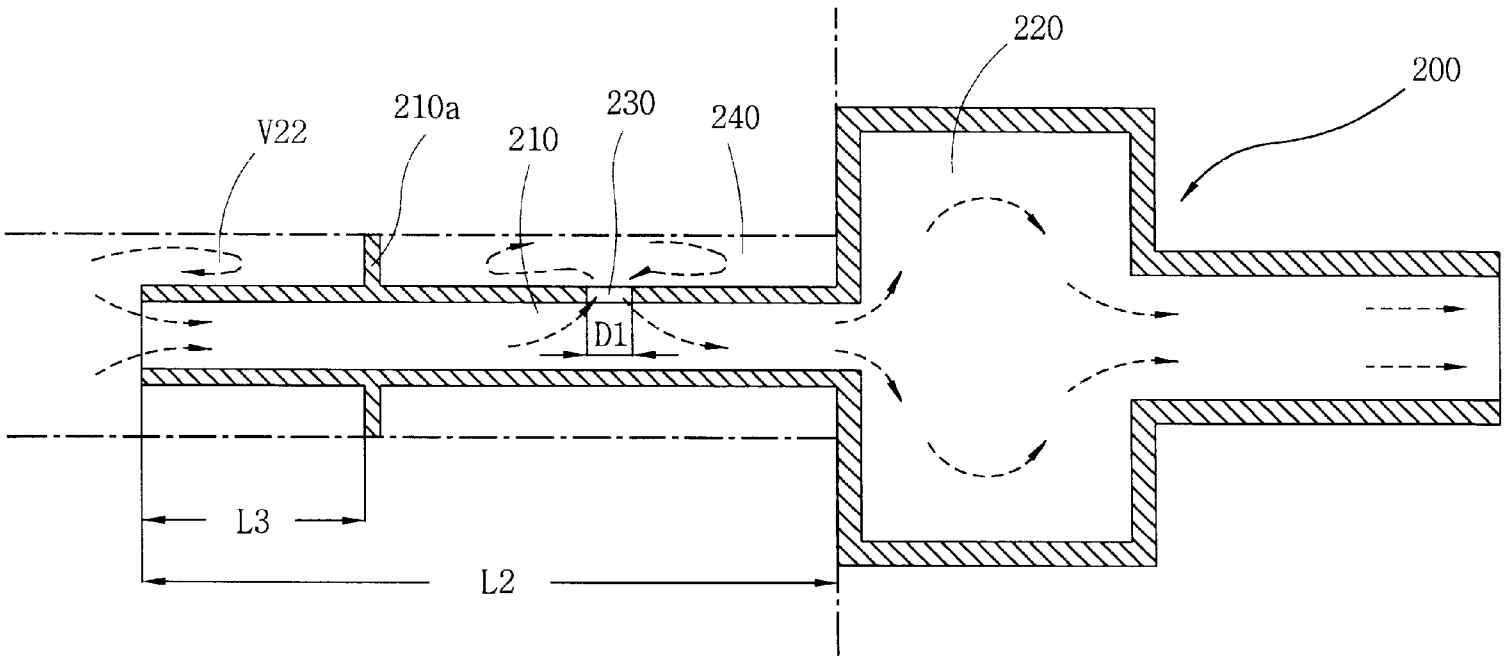
FIG. 9 is an extensive vertical cross-sectional view illustrating a suction guide member installed at the linear compressor in accordance with the second embodiment of the present invention.

More specifically, as shown in FIG. 9, in the suction induction member 200, a first small diameter unit 210 constituting a throat part is inserted into an inner circumferential surface of the refrigerant flow path (F) of the piston 40 at a predetermined interval therefrom, a first large diameter unit 220 communicating with the first small diameter unit 210 and constituting a first resonance chamber is tightly formed at a rear end surface of the piston 40, and a diaphragm boss 210*a* attached at an inner circumferential surface of the refrigerant flow path (F) of the piston 40 for dividing a space for the refrigerant flow path (F) of the piston 40 is formed to be inserted into the inner circumferential surface of the refrigerant flow path (F) of the piston 40 at a predetermined interval therefrom. The enclosed space of both divided spaces is formed as a second large diameter unit 240 constituting a second resonance chamber, and a second small diameter unit 230 is formed between the first small diameter unit 210 and the second large diameter unit 240.

L2 as shown in FIG. 9 denotes the length of the first small diameter unit 210, L3 denotes the length from an inner end of the first small diameter unit 210 to the diaphragm boss 210*a* which is proportional to the sound velocity of the refrigerant and is inversely proportional to a frequency to be reduced, and D1 denotes the diameter of the second small diameter unit 230 which is inversely proportional to the sound velocity of the refrigerant and proportional to a shell mode frequency, wherein D1 is preferably optimized according to the volume of the second resonance chamber.

Reference numeral 250 denotes a suction guide tube.

The operation of the linear compressor in accordance with the second embodiment of the present invention thusly constructed is substantially the same as the first embodiment of the present invention.

Namely, when a current is applied to a stator of a linear motor comprised of inner and outer stator assemblies 30 and 31 to thereby generate an induced magnetic field, a magnet assembly 33, an operator intercalated between the inner and outer stator assemblies 30 and 31, linearly reciprocates by the induced magnetic field and thereby the piston 40 reciprocates in the cylinder 20. As the piston 40 reciprocates in the cylinder 20, refrigerant gas is sucked into the cylinder 20, compressed and discharged after passing through a refrigerant gas suction tube 2, the suction induction member 200 and the refrigerant flow path (F) of the piston 40.

At this time, noise is generated during the suction of the refrigerant gas, of which noise components are firstly reduced at a space (V22) formed between the refrigerant flow path (F) of the piston 40 and the outer circumferential surface of the suction induction member 200. Afterwards, the noise is introduced into the second large diameter unit (Helmholtz resonator) 240, namely, the second resonance chamber via the second small diameter unit 230, while passing through the first small diameter unit 210 again, and then is secondly reduced. Then, it is reduced once again at the first large diameter unit 220, that is, the first resonance chamber, while passing through the first small diameter unit 210.

As described above, when an additional second resonance chamber 220 is formed to communicate with the first small diameter unit 210 communicating with the first resonance chamber 220 of the suction induction member 200, a noise reduction effect is improved without changing the length or sectional area of the first small diameter unit 210 or varying specific volume of the first resonance chamber, thus increasing the noise reduction effect without reducing the efficiency of the compressor.

Hereinafter, the linear compressor in accordance with a third embodiment of the present invention will be described in detail with reference to the accompanying drawings.

With respect to the same structure as of the first embodiment described above, there will be no additional description thereof, and the same reference numerals will be used in the drawings.

Figure 10:
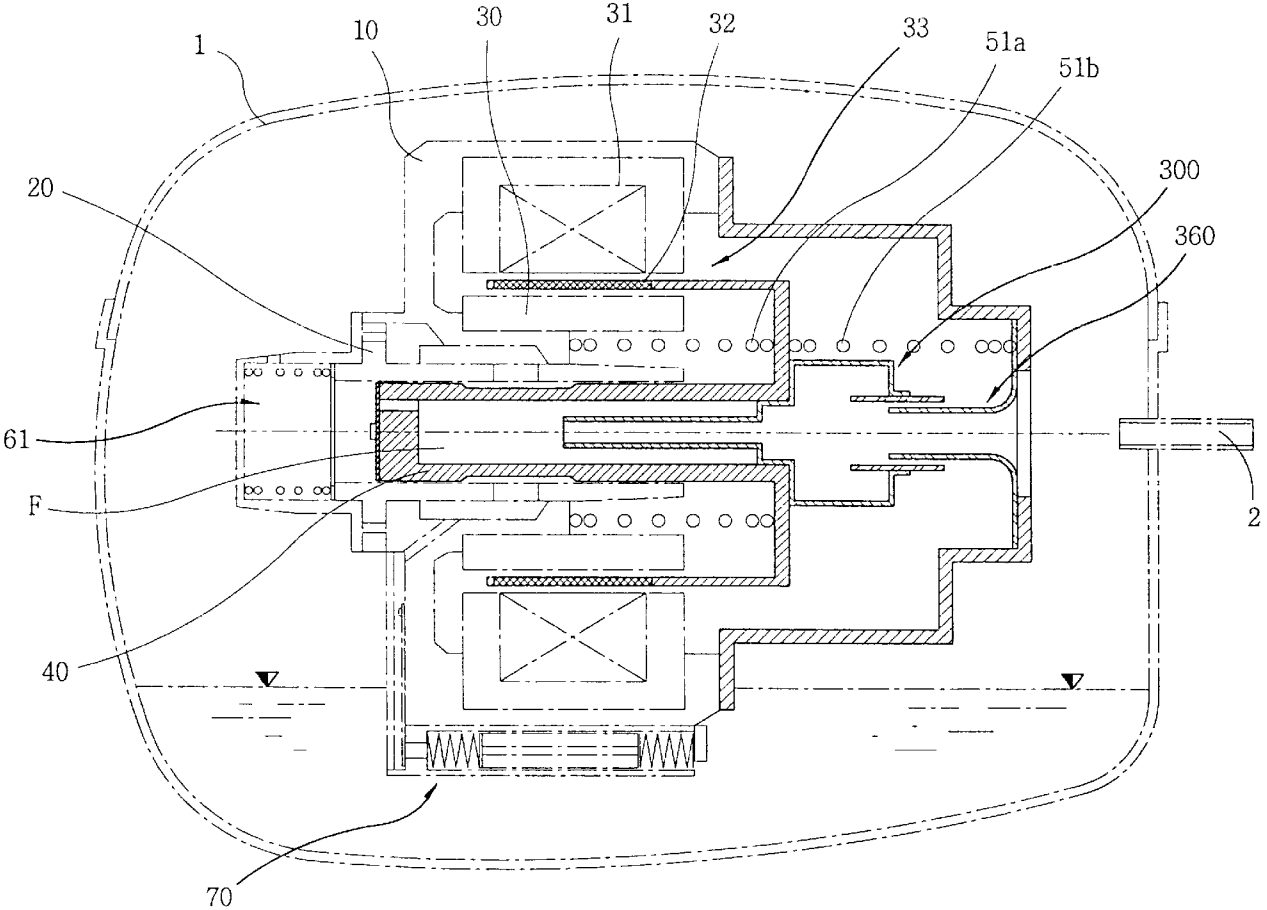
FIG. 10 is a vertical cross-sectional view illustrating a linear compressor in accordance with a third embodiment of the present invention.

As shown in FIG. 10, the linear compressor in accordance with the third embodiment of the present invention includes: a suction induction member 300 mounted to be inserted into the refrigerant flow path (F) of the piston 40 for guiding the suction of the refrigerant gas and decreasing noise during the suction of the refrigerant gas; and a refrigerant gas guide tube 360 fastened to an inner surface of the refrigerant vent hole of the cover 350 so that it is closely inserted into the suction induction member 300.

Figure 11:
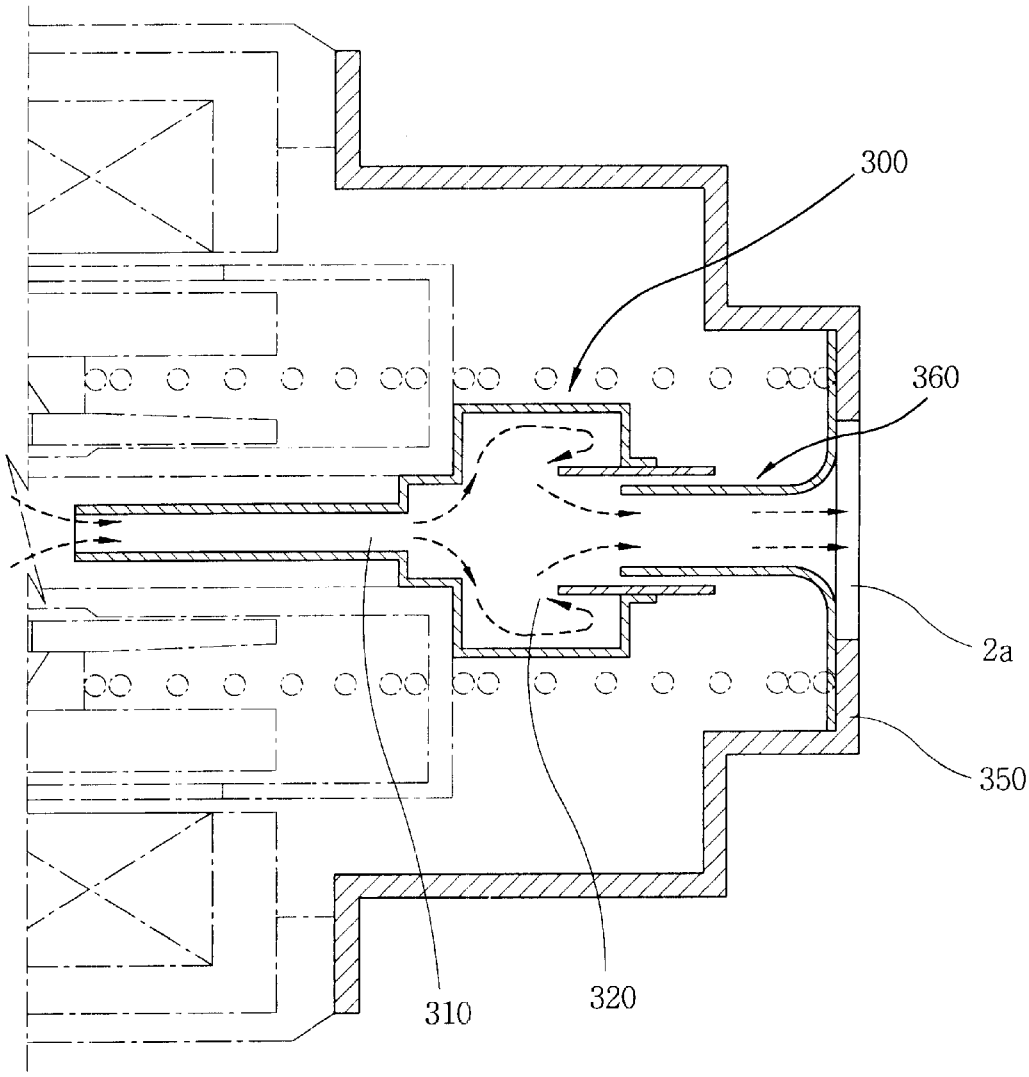
FIG. 11 is an extensive vertical cross-sectional view illustrating a suction guide member and a refrigerant gas guide tube installed at the linear compressor in accordance with the third embodiment of the present invention.

More specifically, as shown in FIG. 11, in the suction induction member 300, a small diameter unit 310 constituting a throat part is inserted into the refrigerant flow path (F) so that the refrigerant gas with which the hermetic vessel 1 is filled during the resonant movement of the piston 40, is directly sucked into the refrigerant flow path (F), and a large diameter unit 320 curved, enlarged and extended many times at the small diameter unit 310 for thereby constituting a resonance chamber is tightly fastened to a rear end surface of the piston 40.

In addition, the other end of the refrigerant guide tube 360 of which one end is fastened to the inner surface of the refrigerant vent hole 2*a* of the cover 350 is formed to have a smaller diameter than that of an end portion of the large diameter unit 320 of the suction induction member 300, and it is fixed to the large diameter unit 320 of the suction induction member 300 in the state of being inserted thereinto.

The operation of the linear compressor in accordance with the third embodiment of the present invention thusly constructed is substantially the same as the first embodiment of the present invention.

Namely, when a current is applied to a stator of a linear motor comprised of inner and outer stator assemblies 30 and 31 to thereby generate an induced magnetic field, a magnet assembly 33, an operator intercalated between the inner and outer stator assemblies 30 and 31, linearly reciprocates by the induced magnetic field and thereby the piston 40 reciprocates in the cylinder 20. As the piston 40 reciprocates in the cylinder 20, refrigerant gas is introduced into the hermetic vessel 1 via the refrigerant gas suction tube 2. The refrigerant gas introduced into the hermetic vessel 1 is sucked into the cylinder 20, compressed and discharged after passing through the refrigerant gas guide tube 360, the suction induction member 300 and the refrigerant flow path (F) of the piston 40.

At this time, the end of the refrigerant gas guide tube 360 inducing the refrigerant gas filling the hermetic vessel 1 is inserted into the large diameter unit 320 of the suction induction member 300, and the suction induction member 300 is insertingly mounted at the refrigerant flow path (F) of the piston 40. Due to this, no gap is generated between the refrigerant gas guide tube 360 and the suction induction member 300 with respect to the suction direction of the refrigerant gas, thus preventing the leakage of the refrigerant gas, which fills the hermetic vessel 1 and then is sucked into the suction induction member 300 and the refrigerant flow path (F) of the piston 40 via the refrigerant gas guide tube 360 during a suction stroke.

In this manner, the suction induction member 300 is insertingly mounted at the refrigerant flow path (F) of the piston 40, the refrigerant gas guide tube 360 is fastened to the inner surface of the suction opening of the cover 350 for covering and opening the suction side of the refrigerant flow path (F), and the inner end of the refrigerant gas guide tube 360 is inserted into the suction induction member 300. By which, the refrigerant gas filling the hermetic vessel 1 is sucked into the refrigerant flow path (F) via the refrigerant gas guide tube 360 and the suction induction member 300 without a leakage. Thus the suction loss of the refrigerant gas is reduced, for thereby substantially improving the efficiency of the compressor.

Hereinafter, the linear compressor in accordance with a fourth embodiment of the present invention will be described in detail with reference to the accompanying drawings.

With respect to the same structure as of the first embodiment described above, there will be no additional description thereof, and the same reference numerals will be used in the drawings.

Figure 12:
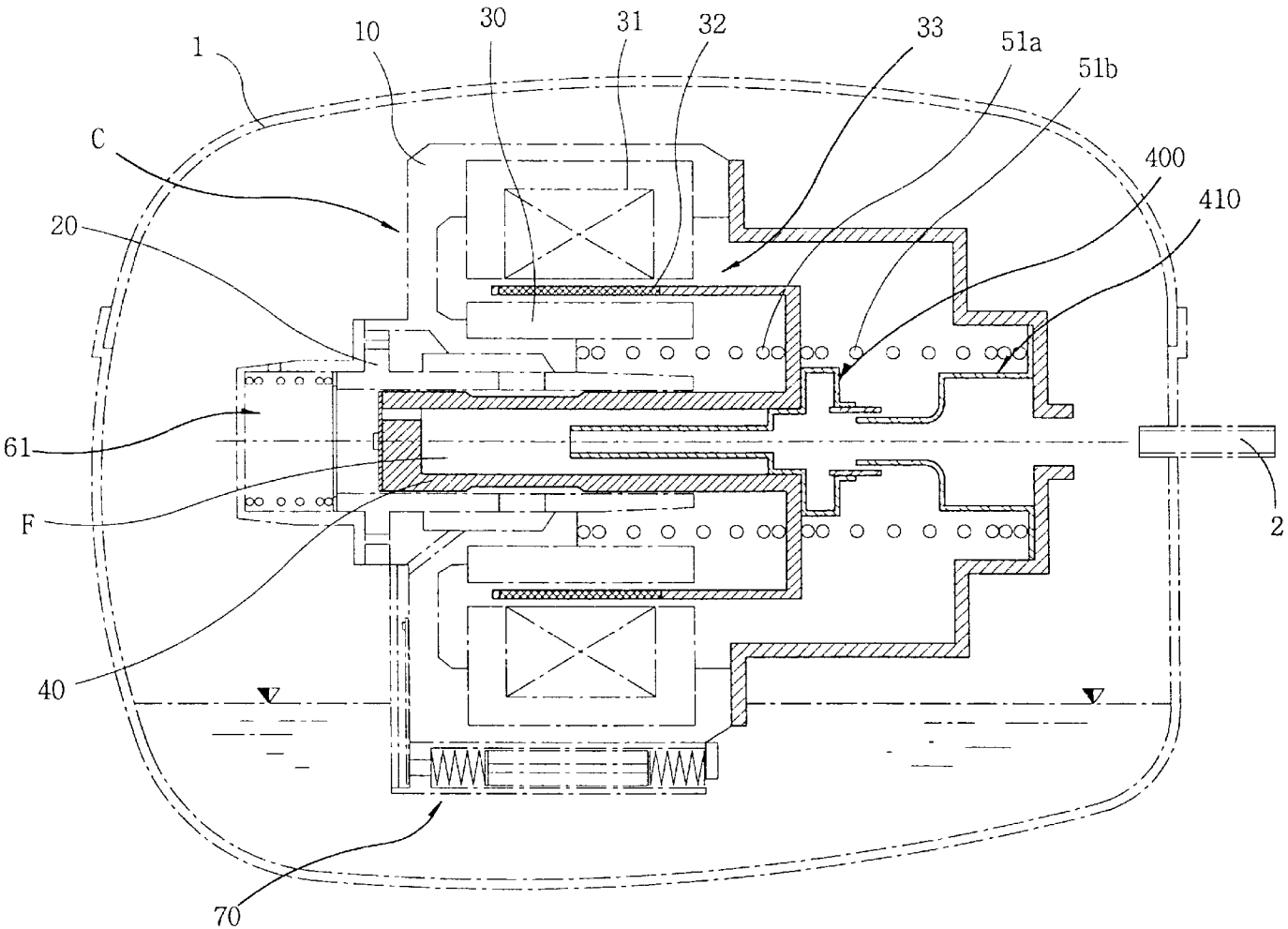
FIG. 12 is a vertical cross-sectional view illustrating a linear compressor in accordance with a fourth embodiment of the present invention.

As shown in FIG. 12, the linear compressor in accordance with the fourth embodiment of the present invention includes: a suction induction member 400 insertingly mounted at the refrigerant flow path (F) of the piston 40 for firstly guiding the suction of the refrigerant gas and firstly decreasing noise during the suction of the refrigerant gas; and a suction guide member 410 of which one side is fastened to the inner surface of the refrigerant vent hole 2*a* of the cover 450 in order to be inserted into the suction induction member 400 for secondly guiding the suction of the refrigerant gas and secondly decreasing noise during the suction of the refrigerant gas.

Figure 13:
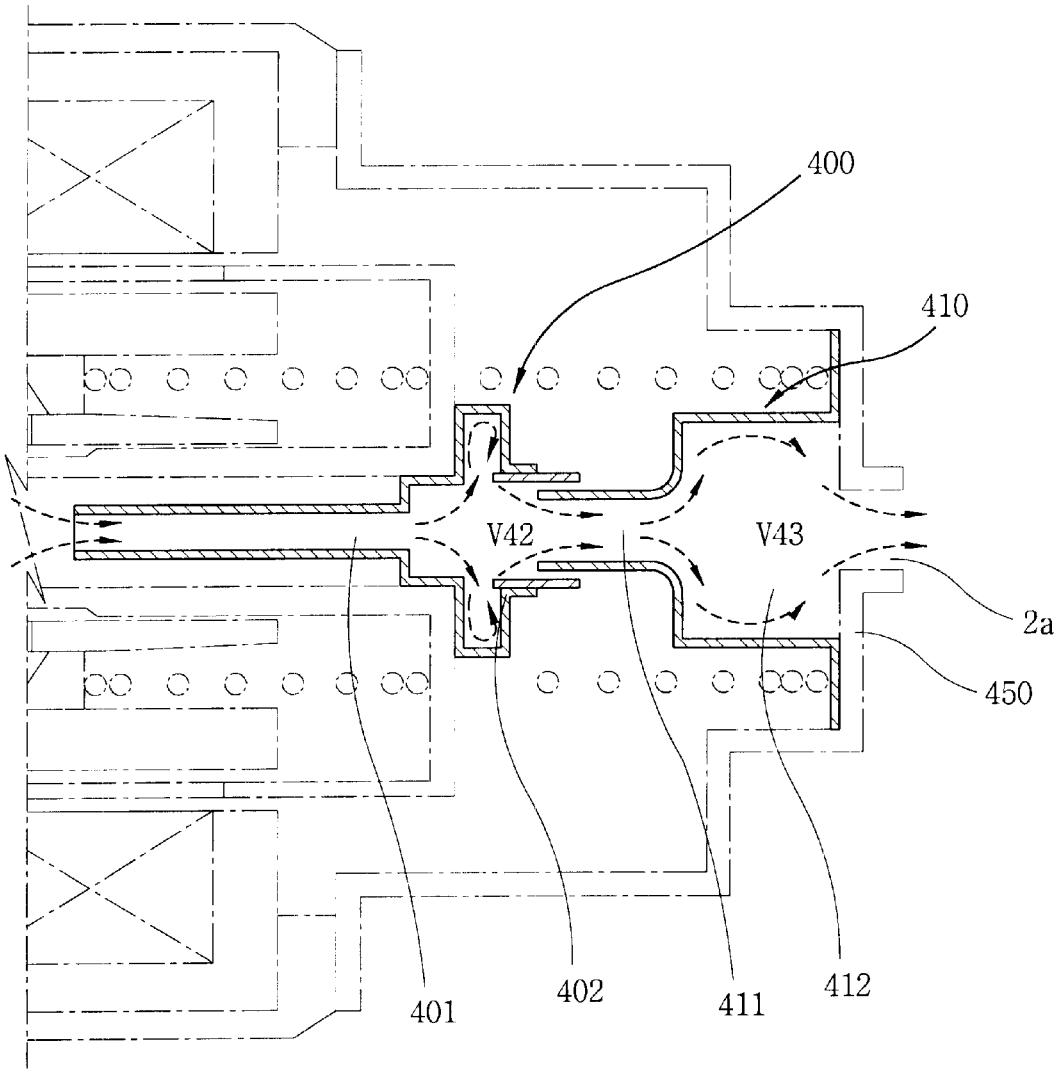
FIG. 13 is an extensive vertical-cross sectional view illustrating a suction induction member and a suction guide member installed at the linear compressor in accordance with the fourth embodiment of the present invention.

More specifically, as shown in FIG. 13, in the suction induction member 400, a small diameter unit 401 constituting a throat part is inserted into the refrigerant flow path (F), and a large diameter unit 402 curved, enlarged and extended many times at the small diameter unit 401 for thereby constituting a resonance chamber is tightly fastened to the rear end surface of the piston 40.

In addition, in the suction guide member 410, a small diameter unit 411 inserted into an end portion of the large diameter unit 402 of the suction induction member 400 for thereby constituting a throat part and an end portion of a large diameter unit 412 enlarged and extended at the small diameter unit 411 is fastened to an inner surface of the refrigerant vent hole 2*a* of the cover 450.

In addition, the volume (V42) of the large diameter unit 402 of the suction induction member 400 and the volume (V43) of the suction guide member 410 are differently formed so that each of the suction induction and suction guide members 400 and 410 reduce noise.

The operation of the linear compressor in accordance with the fourth embodiment of the present invention thusly constructed is substantially the same as the first embodiment of the present invention.

Namely, when a current is applied to a stator of a linear motor comprised of inner and outer stator assemblies 30 and 31 to thereby generate an induced magnetic field, a magnet assembly 33, an operator intercalated between the inner and outer stator assemblies 30 and 31, linearly reciprocates by the induced magnetic field and thereby the piston 40 reciprocates in the cylinder 20. As the piston 40 reciprocates in the cylinder 20, refrigerant gas fills the hermetic vessel 1 via the refrigerant gas suction tube 2. The refrigerant gas with which the hermetic vessel 1 is filled is sucked into the cylinder 20, compressed and discharged after passing through each of the suction induction and suction guide members 400 and 410 and the refrigerant flow path (F) of the piston 40.

Here, during the suction stroke of the piston 40, suction noise is generated in the process of the suction of the refrigerant gas into the refrigerant flow path (F) of the piston 40, or in the process of the suction of the refrigerant gas into the cylinder 20 via the piston 40. However, this suction noise is firstly reduced while passing through the small diameter unit 401 and large diameter unit 402 of the suction induction member 400, and then it is secondly reduced while passing through the small diameter unit 411 and large diameter unit 412 of the suction guide member 410.

In this way, the suction induction member 400 is insertingly mounted at the refrigerant flow path (F) of the piston 40, the suction guide member 410 is fastened to the inner surface of the refrigerant vent hole 2*a* of the cover 450 for covering and opening the suction side of the refrigerant flow path (F), and the small diameter unit 411, that is, a throat part of the suction guide member 410, is inserted into the large diameter unit 402, which is a resonance chamber of the suction induction member 400. By which, suction noises generated during the suction stroke of the piston 40 are reduced one after another while passing through the suction induction member 400 and the suction guide member 410. Particularly, as the volumes of the large diameter units 402 and 412 respective of the suction induction and suction guide members 400 and 410 are different, each of the large diameter units 402 and 412 reduces noise, thus substantially improving the noise reduction effect.

As described above, in the linear compressor of the present invention, the amount of the refrigerant gas sucked into the cylinder, which is mixed with a high temperature refrigerant gas in the hermetic vessel, is reduced during the suction stroke of the piston. Thus, there is an advantage in that the specific volume of the refrigerant gas sucked into the cylinder is decreased, for thereby improving the compressing efficiency of the compressor, making it easier to assemble composing elements, preventing the damage of the elements during the operation of the compressor, and accordingly operating the compressor safely.

In addition, by forming a second small diameter unit allowing some of noises to be discharged to a second large diameter unit provided at the refrigerant flow path of the piston at a first small diameter unit communicating with a first resonance chamber of the suction guide member, the sectional area of the first small diameter unit or the effective volume of the first resonance chamber is not changed. Thus, the noise reduction effect is increased without reducing the compressing effect.

In addition, by insertingly mounting the suction induction member at the refrigerant flow path of the piston, fastening the refrigerant gas guide tube to the inner surface of the suction opening of the cover for covering and opening the suction side of the refrigerant flow path, and inserting the inner end of the refrigerant gas guide tube into the suction guide member, there is another advantage in that the refrigerant gas filling the hermetic vessel is sucked into the refrigerant flow path via the refrigerant gas guide unit and the suction guide member without a leakage for thereby decreasing the suction loss of the refrigerant gas and substantially improving the compressor efficiency.

In addition, because a suction guide member is attached to a cover, the suction guide member can be closely positioned to an inner surface of a vessel.

As the present invention may be embodied in several forms without departing from the spirit or essential characteristics thereof, it should also be understood that the above-described embodiments are not limited by any of the details of the foregoing description unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A suction guide and noise reduction structure for a linear compressor including:

a hermetic vessel having a suction opening at one side thereof, a cylinder disposed inside the hermetic vessel, a piston inserted into the cylinder and having a refrigerant flow path formed inside the piston, and a cover installed inside the hermetic vessel and enclosing the cylinder and the piston and having a through opening, said suction guide and noise reduction structure comprising a suction guide tube connected with the through opening of the cover and fixed to the cover, said suction guide tube guiding refrigerant gas from the suction opening; and a suction induction tube fixedly connected at one end thereof with the refrigerant flow path in the piston and movably connected at another end thereof with one end portion of said suction guide tube.

2. The structure according to claim 1, wherein an outer diameter of the suction induction tube is less than an inner diameter of one end of the suction guide tube so that the suction induction tube is capable of being movably inserted into and fitted in the one end portion of the suction guide tube.

3. The structure according to claim 2, wherein a space maintaining spring is inserted between the suction guide tube and the suction opening for preventing the suction guide tube from colliding with the hermetic vessel.

4. The structure according to claims 2, wherein the suction guide tube has an extended portion extending from the cover toward the suction opening.

5. The structure according to claim 2, wherein another end of the suction guide tube is fixed to the hermetic vessel and in communication with the suction opening of the hermetic vessel.

6. The structure according to claim 2, wherein the suction induction tube comprises:

a first small diameter portion movably connected at one end thereof with the one end portion of the suction guide tube;

a large diameter portion having a diameter larger than that of the first small diameter portion, said large diameter portion being connected to another end of the first small diameter portion and fixed to the piston; and a second small diameter portion having a diameter smaller than that of the first small diameter portion, said second small diameter portion being connected to one end of the large diameter portion and inserted into the refrigerant flow path in the piston.

7. The structure according to claim 6, wherein an outer surface of the second small diameter portion is connected to an inner surface of the piston forming the refrigerant flow path by a diaphragm boss, and an opening is formed in the second small diameter portion between one end thereof connected to the large diameter portion and another end thereof, thus forming a resonance chamber.

8. The structure according to claim 7, wherein a length from the other end of the second small diameter portion opposite to the one end thereof connected to the large diameter portion to a position of the diaphragm boss thereof is determined by a sound velocity of a refrigerant.

9. The structure according to claim 6, wherein the suction guide tube comprises:

a large guide diameter portion fixed at one end thereof to the cover;

a small guide diameter portion having one end thereof connected to another end of the large guide diameter portion and another end thereof moveably connected with the suction induction tube.

10. The structure according to claim 9, wherein an inner diameter of the first small diameter portion is larger than an outer diameter of the one end portion of the suction guide tube so that the one end portion of the suction guide tube is able to be inserted into and fitted in the suction induction tube.

11. The structure according to claim 10, wherein the suction induction tube further comprises a second large diameter portion equal in diameter to a diameter of the refrigerant flow path in the piston, positioned between the second small diameter portion and the large diameter portion.

12. The structure according to claim 10, wherein the first small diameter portion has an extended portion extending toward the inside of the large diameter portion.

13. The structure according to claim 10, wherein an outer surface of the second small diameter portion is connected to an inner surface of the piston forming the refrigerant flow path by a diaphragm boss, and an opening is formed in the second small diameter portion between one end thereof connected to the large diameter portion and another end thereof to form a resonance chamber.

14. The structure according to claim 13, wherein a length from the other end of the second small diameter portion opposite to the one end thereof connected to the large diameter portion to a position of the diaphragm boss thereof is determined by a sound velocity of a refrigerant.

15. The structure according to claim 10, wherein the suction guide tube comprises:

a large guide diameter portion fixed at one end thereof to the cover;

a small guide diameter portion having one end thereof connected to another end of the large guide diameter portion and another end thereof inserted into and fitted in the suction induction tube.

16. The structure according to claim 1, wherein the suction induction tube comprises:

a first small diameter portion movably connected at one end thereof with the one end portion of the suction guide tube;

a large diameter portion having a diameter larger than that of the first small diameter portion, said large diameter portion being connected to another end of the first small diameter portion and fixed to the piston; and a second small diameter portion having a diameter smaller than that of the first small diameter portion, said second small diameter portion being connected to one end of the large diameter portion and inserted into the refrigerant flow path in the piston.

17. The structure according to claim 16, wherein the suction guide tube comprises:

a large guide diameter portion fixed at one end thereof to the cover;

a small guide diameter portion having one end thereof connected to another end of the large guide diameter portion and another end thereof movably connected with the suction induction tube.

18. The structure according to claim 16, wherein an outer surface of the second small diameter portion is connected to an inner surface of the piston forming the refrigerant flow path by a diaphragm boss, and an opening is formed in the second small diameter portion between one end thereof connected to the large diameter portion and another end thereof to form a resonance chamber.

19. The structure according to claim 18, wherein a length from the other end of the second small diameter portion opposite to the one end thereof connected to the large diameter portion to a position of the diaphragm boss thereof is determined by a sound velocity of a refrigerant.

* * * * *